US011719195B2

(12) United States Patent
Saito et al.

(10) Patent No.: US 11,719,195 B2
(45) Date of Patent: Aug. 8, 2023

(54) LIMITING CAP

(71) Applicant: YAMABIKO CORPORATION, Tokyo (JP)

(72) Inventors: Tamotsu Saito, Tokyo (JP); Tomoyoshi Kudo, Tokyo (JP); Yuta Onuma, Tokyo (JP); Ryosuke Imai, Tokyo (JP)

(73) Assignee: YAMABIKO CORPORATION, Tokyo (JP)

( * ) Notice: Subject to any disclaimer, the term of this patent is extended or adjusted under 35 U.S.C. 154(b) by 205 days.

(21) Appl. No.: 17/105,977

(22) Filed: Nov. 27, 2020

(65) Prior Publication Data

US 2021/0164419 A1 Jun. 3, 2021

(30) Foreign Application Priority Data

Nov. 28, 2019 (JP) ..... 2019-215042

(51) Int. Cl.
*F02M 3/10* (2006.01)

(52) U.S. Cl.
CPC ..... *F02M 3/10* (2013.01); *F02M 2003/105* (2013.01)

(58) Field of Classification Search
CPC .... F02M 19/04; F02M 2003/105; F02M 9/08; F02M 17/38; F02M 17/08; F02M 9/00; F02M 7/18; F02M 3/10
See application file for complete search history.

(56) References Cited

U.S. PATENT DOCUMENTS 5,236,634 A * 8/1993 Hammett ..... F02B 63/02 261/DIG. 38
5,252,261 A * 10/1993 Gerhardy ..... F02M 3/10 261/DIG. 38
5,322,645 A * 6/1994 Hammett ..... F02B 63/02 261/DIG. 38

(Continued)

FOREIGN PATENT DOCUMENTS

JP S6173688 A 4/1986
JP 2919305 B2 11/1996

(Continued)

OTHER PUBLICATIONS

"Overmolding Guide" GLS published 2004 (Year: 2004).*
Japanese Office Action dated Apr. 25, 2023 as received in application No. 2019-215042.

*Primary Examiner* — Stephen Hobson
(74) *Attorney, Agent, or Firm* — Maschoff Brennan

(57) ABSTRACT

A limiting cap is provided to restrict rotation of a needle valve and to be easily assembled onto the needle cap. The limiting cap assembled onto the needle valve screwed into an adjustment hole of a fuel adjuster includes a main body to be arranged onto the needle valve. A rising part, which is inserted into a recess of the fuel adjuster, is formed on an outer peripheral surface of the main body. The main body includes a first engagement part on an inner side and a fixing part on an outer side. A first hubbly part formed in an inner peripheral surface of the first engagement part is engageable with a second hubbly part formed in an outer peripheral surface of the needle valve. The needle valve is fixed into the fixing part. The fixing part is formed to have a smaller inner diameter than the first engagement part.

11 Claims, 4 Drawing Sheets

(56) References Cited

U.S. PATENT DOCUMENTS 5,630,965 A * 5/1997 Shaw ..... F02M 3/10 261/DIG. 38
5,635,113 A * 6/1997 Walsh ..... F02M 3/10 261/DIG. 38
5,667,734 A * 9/1997 Ohgane ..... F02M 3/08 261/DIG. 38
5,707,561 A * 1/1998 Swanson ..... F02M 3/10 261/DIG. 38
5,753,148 A * 5/1998 King ..... F02M 3/08 261/DIG. 38
5,984,281 A * 11/1999 Hacker ..... F02M 3/08 261/DIG. 38
6,003,845 A * 12/1999 Kus ..... F02M 19/01 261/39.4
6,302,384 B1 * 10/2001 Douyama ..... F02M 3/10 261/DIG. 38
6,467,757 B1 * 10/2002 Douyama ..... F02D 11/04 137/382
7,097,164 B2 * 8/2006 Vick ..... F02M 3/08 261/DIG. 38
7,097,165 B1 * 8/2006 Braun ..... F02M 3/10 137/382.5
8,286,614 B2 * 10/2012 Zbytowski ..... F02M 19/04 137/382.5
8,348,244 B2 * 1/2013 Kojima ..... F02M 7/12 261/DIG. 38
8,376,324 B2 * 2/2013 Zhang ..... F02M 3/10 261/DIG. 38
8,544,829 B2 * 10/2013 Baumhauer ..... F02M 3/02 137/382.5
9,273,637 B2 * 3/2016 Levien ..... F02M 3/10
10,738,741 B2 * 8/2020 Doyama ..... F02M 19/04
2001/0026025 A1 * 10/2001 Nagata ..... F02M 19/04 261/DIG. 38
2009/0145408 A1 * 6/2009 Zbytowski ..... F02M 17/04 123/517
2012/0018908 A1 * 1/2012 Kojima ..... F02M 7/18 261/DIG. 38
2014/0093329 A1 * 4/2014 Levien ..... F02M 3/08 411/393
2016/0186692 A1 * 6/2016 Suzuki ..... F02M 3/10 261/43
2017/0363045 A1 * 12/2017 Doyama ..... F02M 19/04
2017/0370328 A1 * 12/2017 Braun ..... F02M 7/14

FOREIGN PATENT DOCUMENTS

JP 2001065408 A 3/2001
JP 2005290748 A 10/2005

* cited by examiner

LIMITING CAP

CROSS-REFERENCE TO RELATED APPLICATION

The present application claims the benefit of priority to Japanese Patent Application No. 2019-215042 filed on Nov. 28, 2019, the disclosures of all of which are hereby incorporated by reference in their entireties.

FIELD

The present disclosure relates to a limiting cap used for adjusting an air-fuel ratio of an air-fuel mixture.

BACKGROUND

A carburetor of an internal combustion engine includes needle valves for adjusting an air-fuel ratio of an air-fuel mixture. Each needle valve is screwed into a thread groove formed in an adjustment hole which communicates with a flow path in the carburetor. The needle valve is rotated about the axis to adjust a protrusion amount thereof into the flow path, to allow for increasing or decreasing a flow rate of fuel flowing through the flow path.

A limiting cap in a cylindrical shape for restricting rotation of the needle valve is fitted onto the needle valve in a related art (see, Japanese Patent No. 2919305, for example). The limiting cap includes a fixing part and an engagement part, and a first splined part is formed in the inner peripheral surface of the engagement part.

A flange of the needle valve is press-fitted into the fixing part of the limiting cap, and the first splined part of the limiting cap is engaged with a second splined part of the needle valve.

Further, a rising part is formed on the outer peripheral surface of the limiting cap. The rising part is inserted into a recess formed in the outer surface of the carburetor, and movement of the rising part is restricted by the recess. Therefore, rotation of the needle valve is restricted.

The limiting cap as described above in a related art includes the fixing part formed on an inner side (closer to the carburetor) and the engagement part formed on an outer side (away from the carburetor), and the fixing part is formed to have a larger diameter than the engagement part. The needle valve assembled into the limiting cap described above includes the second splined part formed on an outer side of the flange.

When the limiting cap described above in a related art is fixed onto the needle valve, with the engagement part being located on the outer side and the fixing part being located on the inner side, the fixing part is located away from an operator at the time of fixing operation, to have a problem that it is difficult to assemble the limiting cap onto the needle valve.

The present disclosure is intended to solve the problem described above, and to provide a limiting cap which restricts rotation of a needle valve and is easily assembled onto the needle valve.

SUMMARY

To solve the problem described above, the present disclosure provides a limiting cap assembled onto a needle valve which is screwed into an adjustment hole of a fuel adjuster. The limiting cap includes a main body in a cylindrical shape to be arranged onto a protruding part of the needle valve which protrudes from the adjustment hole, and a rising part, which is inserted into a recess formed in the fuel adjuster for restricting rotation of the needle valve, is formed on an outer peripheral surface of the main body. The main body includes an engagement part on an inner side and a fixing part on an outer side. A first hubbly part formed in an inner peripheral surface of the engagement part is engageable in a circumferential direction of the main body with a second hubbly part formed in an outer peripheral surface of the needle valve. The needle valve is fixed into the fixing part. The fixing part is formed to have a smaller inner diameter than the engagement part.

The limiting cap of the present disclosure is assembled onto the needle valve, and the rising part of the main body is inserted into the recess of the fuel adjuster. Movement of the rising part is restricted by the recess. Therefore, rotation of the needle valve is restricted.

When the limiting cap of the present disclosure is fixed onto the needle valve, with the engagement part being located on the inner side and the fixing part being located on the outer side. The fixing part is fixed on the outer side of the fuel adjuster at the time of fixing operation, while the limiting cap is easily positioned to engage with the needle valve. Therefore, the limiting cap is easily assembled onto the needle valve.

DETAILED DESCRIPTION

A description will be given in detail of an example of an embodiment of the present disclosure, with reference to the drawings as appropriate.

Figure 1:
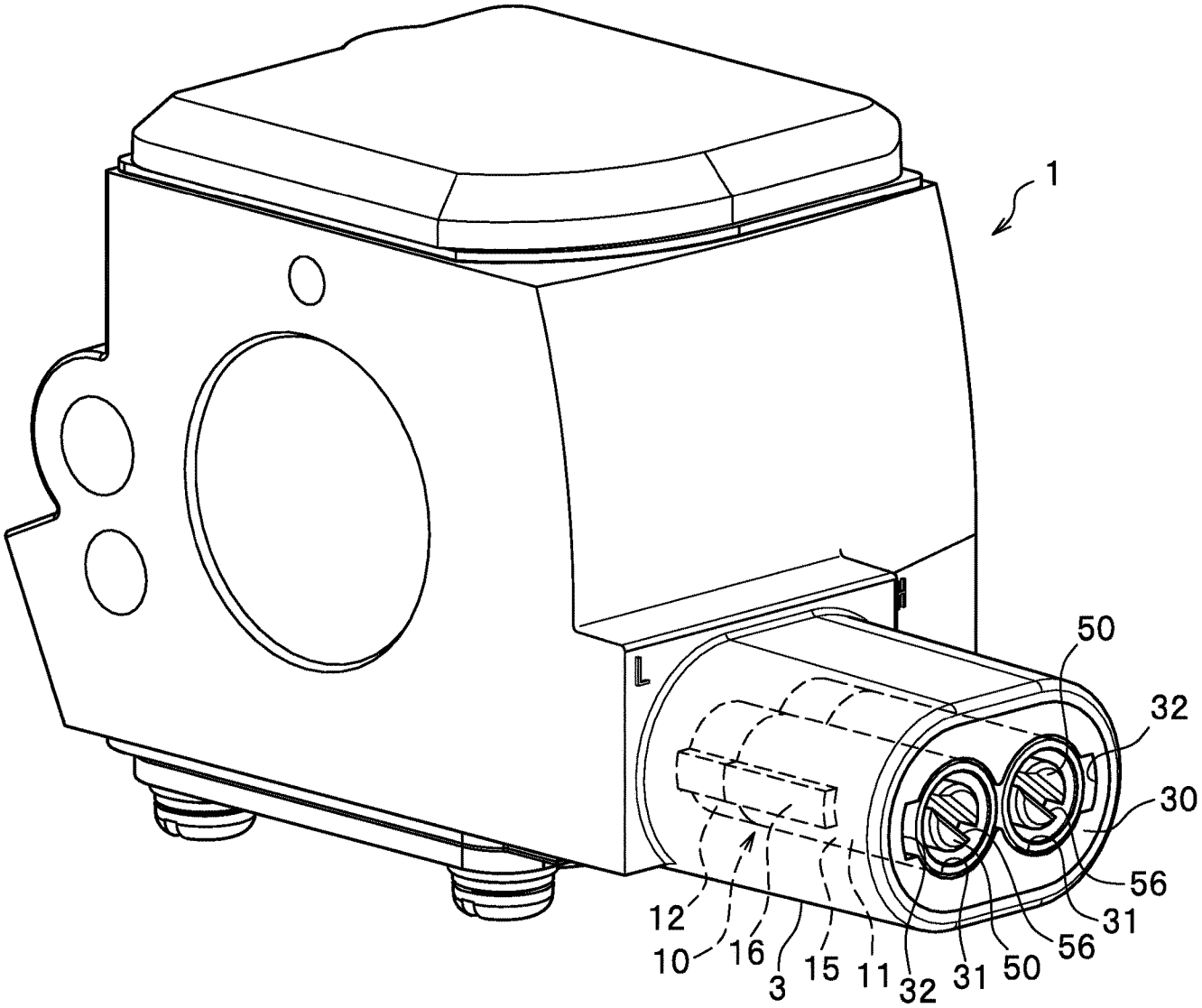
FIG. 1 is a perspective view of a carburetor assembled with a limiting cap according to an embodiment of the present disclosure.

As shown in FIG. 1, a limiting cap 10 of the present embodiment is used for a carburetor 1 (intake device) as an example of a fuel adjuster for an internal combustion engine of small outdoor power equipment such as a chain saw and a blower.

The carburetor 1 is formed therein with flow paths to generate a fuel-air mixture of fuel and air. The carburetor 1 includes a peripheral wall part 3 cross-sectionally in an elliptical shape protruding from an outer surface of the carburetor 1.

Figure 5:
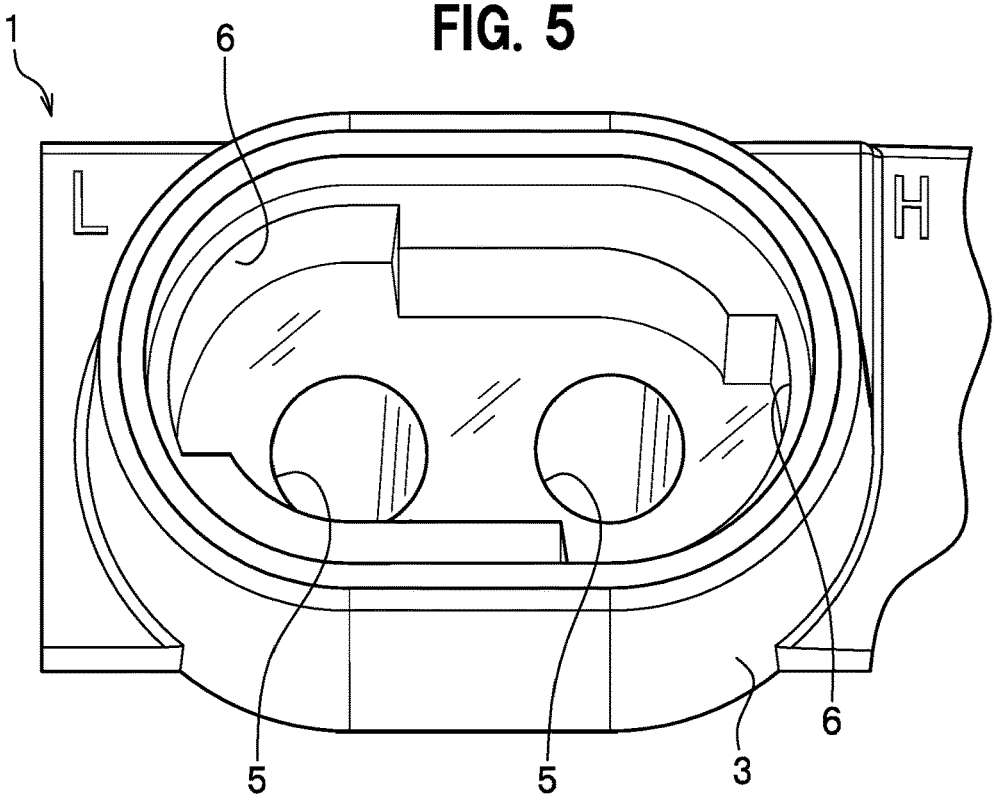
FIG. 5 is a front view of adjustment holes formed in the carburetor associated with the limiting caps according to the embodiment of the present disclosure.

As shown in FIG. 5, two adjustment holes 5 are open in an inner region of the peripheral wall part 3 on the outer surface of the carburetor 1. The adjustment holes 5 are formed side by side. Each adjustment hole 5 is a through hole having a circular cross section and communicates with the flow path through which the fuel flows. A thread groove is formed in the inner peripheral surface of the adjustment hole 5.

In the carburetor 1 of the present embodiment, the adjustment hole 5 formed on the left side in FIG. 5 is a hole to be used for adjusting an air-fuel ratio of an air-fuel mixture when the output shaft of the internal combustion engine rotates at low speed. Further, the adjustment hole 5 formed on the right side in FIG. 5 is a hole to be used for adjusting the air-fuel ratio of the air-fuel mixture when the output shaft of the internal combustion engine rotates at high speed.

In the present embodiment, structures of the adjustment holes 5 and components assembled to the adjustment holes 5 are the same. Therefore, in the following description, the adjustment hole 5 formed on the left side in FIG. 5 and each component assembled to the adjustment hole 5 will be described, whereas descriptions of the said adjustment hole 5 formed on the right side in FIG. 5 and components assembled to the said adjustment hole 5 are omitted.

Figure 2:
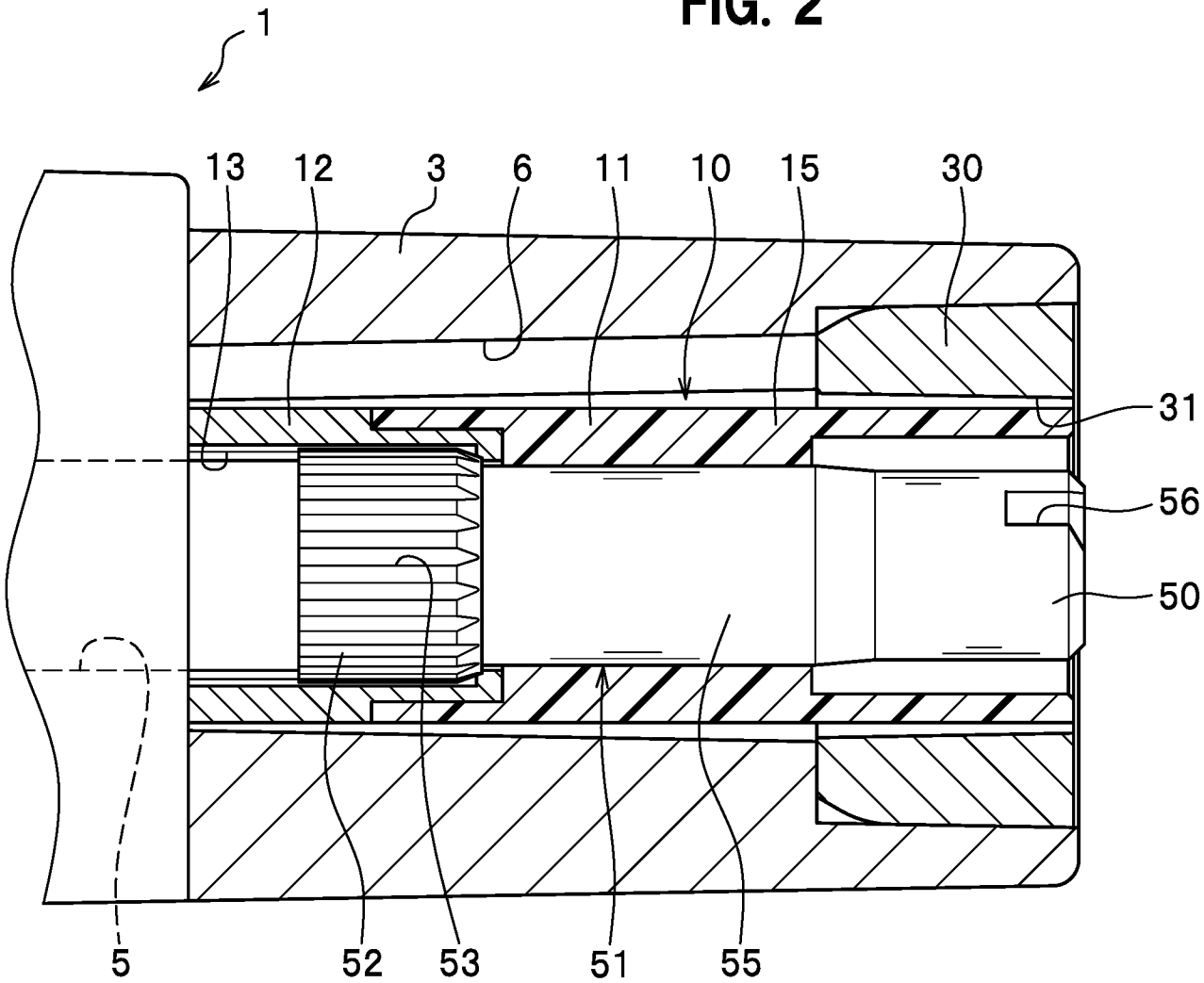
FIG. 2 is a side cross-sectional view of the limiting cap according to the embodiment of the present disclosure, a needle valve, and a carburetor.

As shown in FIG. 2, a needle valve 50 for adjusting the air-fuel ratio of the air-fuel mixture is inserted into the adjustment hole 5.

Figure 3:
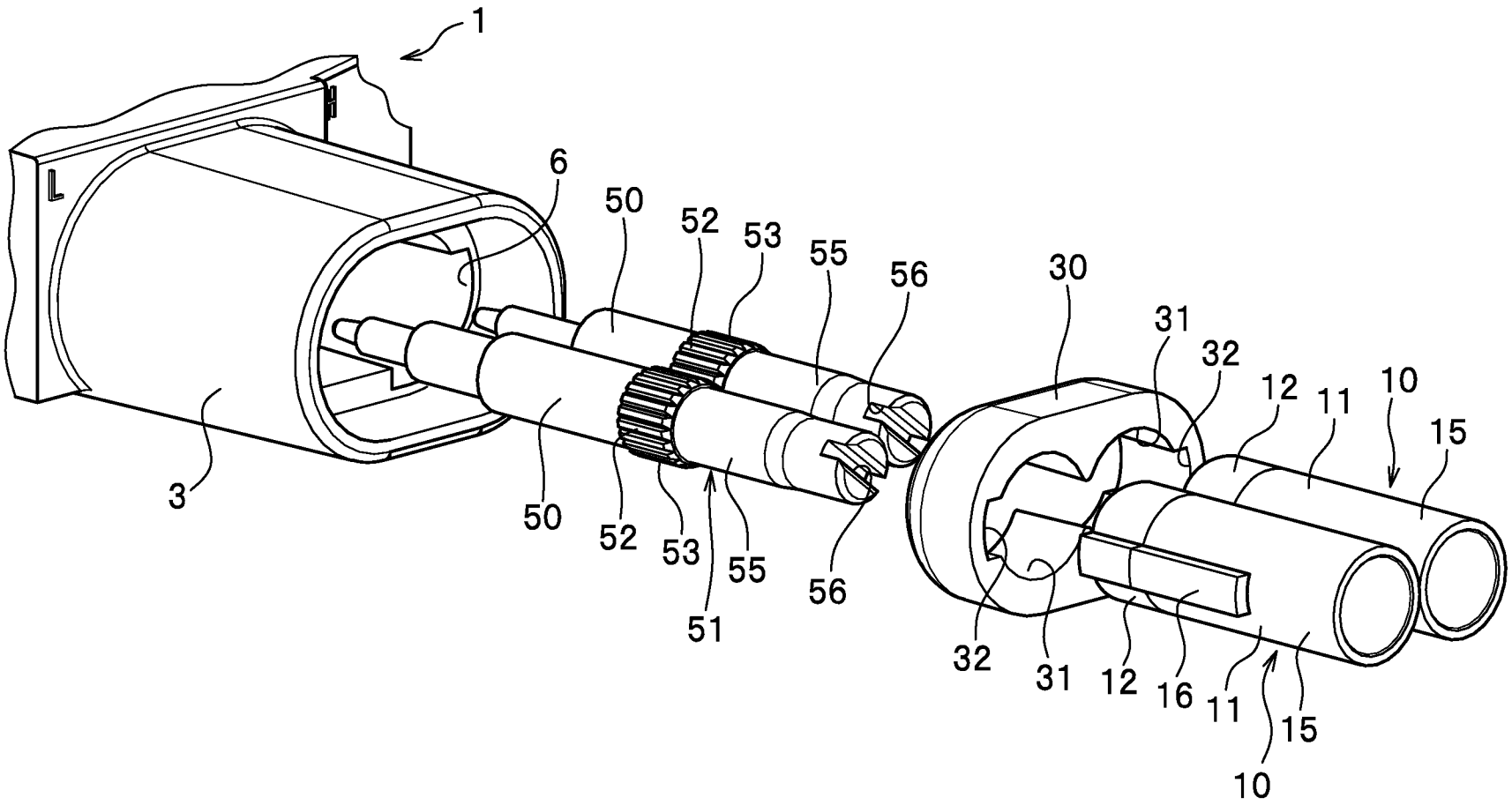
FIG. 3 is an exploded perspective view of the limiting caps according to the embodiment of the present disclosure, the needle valves, and the carburetor.

As shown in FIG. 3, the needle valve 50 is a straight member having a circular cross section. A thread groove is formed in the outer peripheral surface of a portion near the inner end (left side in FIG. 2) of the needle valve 50. As shown in FIG. 2, the portion near the inner end of the needle valve 50 is screwed into the thread groove of the adjustment hole 5.

The needle valve 50 is rotated about the axis to increase or decrease an insertion amount of the needle valve 50 into the adjustment hole 5. Adjusting a protrusion amount of the needle valve 50 into the flow path allows for adjusting the flow rate of the fuel flowing through the flow path. Thus, the air-fuel ratio of the air-fuel mixture is adjusted by the rotation of the needle valve 50 about the axis.

A protruding part 51 of the needle valve 50, which protrudes from the adjustment hole 5 to the outer side of the carburetor 1, is accommodated in the peripheral wall part 3.

Figure 4:
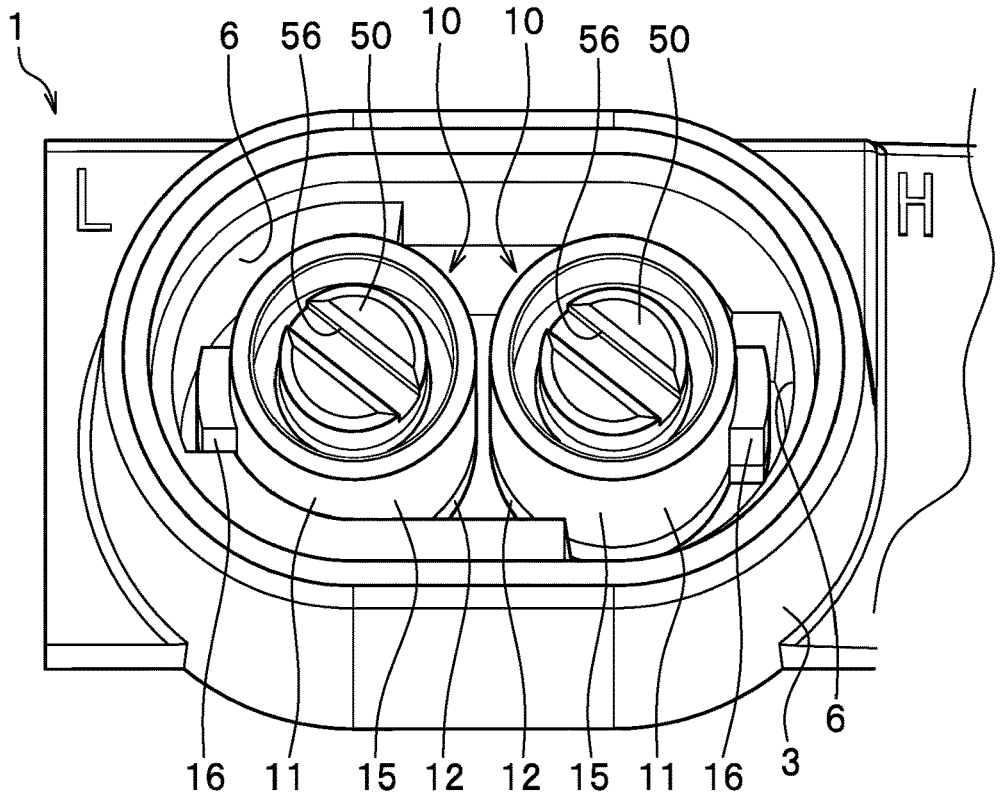
FIG. 4 is a front view of the limiting caps according to the embodiment of the present disclosure, the needle valves, and the carburetor.

As shown in FIG. 4, a groove 56 is formed in the outer end surface of the needle valve 50, so as to be used for rotating the needle valve 50 about the axis with a tool such as a screwdriver.

Note that, in the present embodiment, the groove 56 is formed straight to be engaged with the tip of a straight-head screwdriver, but the tool for rotating the needle valve 50 is not limited thereto. For example, a cross-shaped groove may be formed in a base end surface of the needle valve 50 to correspond to a cross-head screwdriver, or a hexagonal hole may be formed in the base end surface of the needle valve 50 to correspond to a hexagonal-head wrench.

As shown in FIG. 3, the outer peripheral surface of the protruding part 51 of the needle valve 50 is formed with a second engagement part 52 formed with a second splined (bubbly) part 53, and a needle valve fixed part 55. The needle valve fixed part 55 is a part to be press-fitted into a fixing part 15, which is described below, of the limiting cap 10.

The outer peripheral surface of the second engagement part 52 is applied with knurling (straight knurling) to have the second splined part 53 by knurling over the entire surface thereof. The second splined part 53 is formed with straight grooves extending in the axial direction of the needle valve 50 and is arranged at equal intervals in the circumferential direction of the second engagement part 52.

Note that, in the present embodiment, the second splined part 53 is formed in the second engagement part 52 by knurling, but the forming method is not limited thereto. For example, the second engagement part 52 may be cut, assembled with other components, molded, or the like to form the second splined part 53.

As shown in FIG. 2, the needle valve fixed part 55 is continuously formed closer to the outer end of the needle valve 50 than the second engagement part 52. The outer peripheral surface of the needle valve fixed part 55 is not knurled. The needle valve fixed part 55 is formed to have a smaller outer diameter than the second engagement part 52, and further, than the minimum outer diameter of the second engagement part 52.

The limiting cap 10 includes a main body 11 in a cylindrical shape fitted onto the protruding part 51 of the needle valve 50. The main body 11 has the inner end surface and the outer end surface fully opened in a circular shape (see FIG. 3).

As shown in FIG. 3, the main body 11 includes a first engagement part 12 on the inner side (closer to the carburetor 1) and the fixing part 15 on the outer side (away from the carburetor 1). The first engagement part 12 and fixing part 15 are separate members, and the outer end of the first engagement part 12 is coupled to the inner end of the fixing part 15.

The first engagement part 12 of the present embodiment is a metal member, and the fixing part 15 is a resin member. Therefore, the first engagement part 12 is harder than the fixing part 15.

The first engagement part 12 and fixing part 15 are integrally molded by insert molding to form a single component.

A rising part 16 extending axially is formed on the outer peripheral surface of the main body 11. The rising part 16 has an axial cross section in a square shape. The rising part 16 extends straight from the inner edge of the first engagement part 12 to the middle in the axial direction of the fixing part 15.

The inner peripheral surface of the first engagement part 12A has a first splined part 13 formed over the entire surface thereof. The first splined part 13 is formed with straight grooves extending in the axial direction of the main body 11 and arranged at equal intervals in the circumferential direction of the first engagement part 12.

As shown in FIG. 2, in a state where the main body 11 is fitted onto the protruding part 51 of the needle valve 50, the first splined part 13 of the first engagement part 12 is engaged with the second splined part 53 of the needle valve 50 in the circumferential direction of the needle valve 50 and the main body 11. Accordingly, the main body 11 rotates about the axis in conjunction with the needle valve 50 rotating about the axis.

As shown in FIG. 4, a recess 6, into which the rising part 16 of the main body 11 is inserted, is formed in the inner peripheral surface of the peripheral wall part 3 of the carburetor 1. Note that FIG. 4 shows a state that a guide member 30 to be described below is removed from the peripheral wall part 3.

As shown in FIG. 5, the recess 6 is formed in the inner peripheral surface of the peripheral wall part 3, and extends straight in a protruding direction of the peripheral wall part 3. Further, the axial cross section of the recess 6 is curved in an arc shape along the rim of the adjustment hole 5. The axial cross section of the recess 6 of the present embodiment is curved in an arc subtending a central angle of approximately 90 degrees.

As shown in FIG. 4, in the present embodiment, a length in the circumferential direction of the recess 6 is set such that the rising part 16 inserted into the recess 6 is rotatable about the axis of the adjustment hole 5 in a range of rotation angle of 90 degrees. Accordingly, the main body 11 is rotatable by a quarter turn about the axis. Further, the needle valve 50 assembled in the main body 11 is also rotatable by a quarter turn about the axis.

As shown in FIG. 2, the fixing part 15 is a cylindrical part into which the needle valve fixed part 55 of the needle valve 50 is press-fitted. The fixing part 15 is formed to have a smaller inner diameter than the first engagement part 12. More specifically, the fixing part 15 is formed to have a smaller inner diameter than the minimum inner diameter of the first engagement part 12.

The needle valve fixed part 55 of the needle valve 50 is press-fitted into the fixing part 15 of the main body 11, and hence the needle valve 50 and the limiting cap 10 are axially fixed.

As shown in FIG. 1, the guide member 30 is fitted in the peripheral wall part 3. Guide holes 31, which communicate with the adjustment holes 5 (see FIG. 5), are formed in the guide member 30. A guide groove 32 extending axially is formed in the inner peripheral surface of each guide hole 31.

As shown in FIG. 3, the guide groove 32 is a part through which the rising part 16 of the main body 11 passes when the main body 11 is inserted into the guide hole 31 from the outer side.

In a state where the inner edge of the main body 11 is in contact with the outer surface of the carburetor 1, the entire rising part 16 is arranged on the inner side (closer to the carburetor 1) with respect to the guide groove 32 (see FIG. 1). Accordingly, the main body 11 is rotatable about the axis without engaging with the guide groove 32.

When the main body 11 is inserted into the guide hole 31 from the outer side, orientation about the axis of the main body 11 is adjusted to allow the rising part 16 of the main body 11 to pass through the guide groove 32. Thus, when the main body 11 is assembled into the guide hole 31, as shown in FIG. 4, the rising part 16 is arranged at one end in the circumferential direction of the axial cross section of the recess 6.

Next, a description is given of a procedure to assemble the guide member 30, the needle valve 50, and the limiting cap 10 to the adjustment hole 5 of the carburetor 1, as shown in FIG. 2.

At first, the inner end portion of the needle valve 50 is inserted in the adjustment hole 5 to screw the thread groove of the needle valve 50 into the thread groove of the adjustment hole 5.

Then, the needle valve 50 is rotated about the axis to increase or decrease the insertion amount of the needle valve 50 into the adjustment hole 5. Adjusting the protruding amount of the inner end of the needle valve 50 into the flow path allows for adjusting the air-fuel ratio of the air-fuel mixture.

After or before the air-fuel ratio of the air-fuel mixture is properly adjusted, the guide member 30 is fitted into the peripheral wall part 3, as shown in FIG. 1. Then, the main body 11 of the limiting cap 10 is inserted into the guide hole 31 of the guide member 30 from the outer side. At this time, the rising part 16 of the main body 11 is passed through the guide groove 32 of the guide member 30.

As shown in FIG. 2, when the main body 11 is moved, the first splined part 13 of the main body 11 is axially moved to mesh with the second splined part 53 of the needle valve 50. Accordingly, the first engagement part 12 of the main body 11 is circumferentially engaged with the second engagement part 52 of the needle valve 50. Note that, before the first splined part 13 meshes with the second splined part 53, the air-fuel ratio of the air-fuel mixture may be adjusted with the needle valve 50.

Further, the needle valve fixed part 55 of the needle valve 50 is press-fitted into the fixing part 15 of the main body 11, to cause the needle valve 50 and the main body 11 to be fixed axially.

Thus, once the limiting cap 10 is assembled on the protruding part 51 of the needle valve 50, as shown in FIG. 4, the rising part 16 of the main body 11 is disposed at one end in the circumferential direction, in the axial cross section, of the recess 6.

The rising part 16 is rotatable clockwise by a quarter turn in FIG. 4 in the recess 6 from a reference position where the rising part 16 is disposed at the one end in the circumferential direction in the axial cross section of the recess 6.

Thus, the limiting cap 10 and the needle valve 50 are rotatable clockwise by a quarter turn in FIG. 4 from the reference position where the needle valve 50 has been assembled into the adjustment hole 5 and the air-fuel ratio of the air-fuel mixture has been properly adjusted.

In the present embodiment, when the needle valve 50 is rotated clockwise from the reference position in FIG. 4, fuel concentration of the air-fuel mixture decreases.

The rising part 16 cannot be rotated counterclockwise in FIG. 4 from the reference position due to the recess 6, and hence the needle valve 50 cannot be rotated counterclockwise in FIG. 4 from the reference position. Thus, in the present embodiment, the fuel concentration does not become higher than the air-fuel ratio of the air-fuel mixture at the reference position of the needle valve 50.

As shown in FIG. 2, the limiting cap 10 as described above is assembled onto the needle valve 50 which is screwed into the adjustment hole 5 of the carburetor 1 (fuel adjuster). The limiting cap 10 includes the main body 11 in a cylindrical shape to be arranged on the protruding part 51 of the needle valve 50 which protrudes from the adjustment hole 5.

As shown in FIG. 4, the rising part 16 is formed on the outer peripheral surface of the main body 11, which is inserted into the recess 6 formed in the carburetor 1 to restrict the rotation of the limiting cap 10.

As shown in FIG. 2, the main body 11 includes the first engagement part 12 on the inner side and the fixing part 15 on the outer side. The first splined part 13 formed in the inner peripheral surface of the first engagement part 12 is engageable in the circumferential direction of the main body 11 with the second splined part 53 formed in the outer peripheral surface of the needle valve 50. Further, the needle valve fixed part 55 of the needle valve 50 is fixed in the fixing part 15. The fixed part 15 is formed to have a smaller inner diameter than the first engagement part 12. Still further, the fixing part 15 may be formed to have a smaller inner diameter than the minimum inner diameter of the first engagement part 12.

As shown in FIG. 4, the rising part 16 formed on the main body 11 of the limiting cap 10 of the present embodiment is arranged in the recess 6 of the carburetor 1. Therefore, the movement of the rising part 16 is restricted by the recess 6, to restrict the rotation of the needle valve 50. Accordingly, the fuel concentration of the air-fuel mixture is kept within an appropriate range.

The main body 11 of the limiting cap 10 of the present embodiment has the outer end surface fully opened. With this structure, the tip of a general-purpose tool such as a screwdriver is inserted inside the main body 11 from the outer end to engage with the needle valve 50. Therefore, the air-fuel ratio of the air-fuel mixture is easily adjusted. In other words, the outer end surface of the main body 11 is widely open, requiring no special tool (tool with a thin tip, for example). Further, the tip of the tool is easily inserted accurately into the groove 56 of the needle valve 50, and hence the groove 56 is less likely to be deformed.

As shown in FIG. 2, when the limiting cap 10 is fixed onto the needle valve 50, the limiting cap 10 of the present embodiment includes the first engagement part 12 positioned on the inner side and the fixing part 15 positioned on the outer side. At the time of the fixing operation, the fixing part 15 is fixed on the outer side of the carburetor 1 while the limiting cap 10 is easily engaged with the needle valve (for example, when an operator pushes the limiting cap 10 in a press-fitting operation, if the needle valve fixed part 55 is located closer to the operator, the limiting cap 10 is easily assembled).

When the operator pushes the limiting cap 10 onto the needle valve 50, the fixing part 15 of the limiting cap 10 of the present embodiment is located close to the position where the operator holds and pushes the limiting cap 10 onto the needle valve 50. Therefore, the press-fitting operation of the limiting cap 10 onto the needle valve 50 is easily performed.

As shown in FIG. 3, the needle valve 50, onto which the limiting cap 10 of the present embodiment is fixed, includes the needle valve fixed part 55 on the outer side of the second engagement part 52, and the needle valve fixed part 55 has a smaller diameter than the second engagement part 52.

The needle valve 50 described above includes the second engagement part 52 having a larger diameter than the needle valve fixed part 55. Therefore, the second splined part 53 of the second engagement part 52 is easily formed when the second engagement part 52 is processed. For example, when concave parts are to be processed in the surface of the second engagement part 52, if the needle valve fixed part 55 has a larger diameter than the second engagement part 52, the concave parts are not easily processed. Especially, when the second engagement part 52 is adjacent to the needle valve fixed part 55, it is remarkably difficult to process the second engagement part 52.

The needle valve 50, onto which the limiting cap 10 of the present embodiment is fixed, includes the needle valve fixed part 55 formed on the outer side of the second engagement part 52 with a smaller diameter than the second engagement part 52. Further, the second splined part 53 is processed by knurling in the second engagement part 52.

The needle valve 50 described above includes the second engagement part 52 having a larger diameter than the needle valve fixed part 55. Therefore, the second engagement part 52 is easily formed when the second engagement part 52 is processed.

The needle valve 50 applied with the limiting cap 10 of the present embodiment includes the needle valve fixed part 55 formed on the outer side of the second engagement part 52, and the needle valve fixed part 55 has a smaller diameter than the second engagement part 52.

In the manufacturing method of the needle valve 50 described above, firstly, the second splined part 53 is formed in the outer peripheral surface of the shaft member. At this time, the second splined part 53 may be also formed in the outer peripheral surface of a portion to be formed as the needle valve fixed part 55. Secondly, the outer peripheral surface of the portion to be formed as the needle valve fixed part 55 in the shaft member is machined to have a reduced diameter, to form the needle valve fixed part 55 on the outer side of the second engagement part 52. With the manufacturing method, the second engagement part 52 and the needle valve fixed part 55 are easily processed in the needle valve 50. Further, the second engagement part 52 has a larger diameter than the needle valve fixed part 55 so that the second engagement part 52 is easily processed. Accordingly, the second splined part 53 of the second engagement part 52 may be formed after the needle valve fixed part 55 is processed.

The first engagement part 12 and the fixing part 15 of the limiting cap 10 of the present embodiment are separate members. With the structure, the first engagement part 12 and the fixing part 15 are made of materials suitable therefor, respectively.

The first engagement part 12 is harder than the fixing part 15 of the limiting cap 10 of the present embodiment.

With the structure, the first engagement part 12 of the main body 11 is not easily deformed so that the first splined part 13 is securely engaged with the second splined part 53 of the needle valve 50.

Further, the fixing part 15 of the main body 11 is a soft and deformable member suitable for being fixed onto the needle valve 50, as compared with the first engagement part 12. For example, the fixing part 15 of the main body 11 is suitable for fixing by press-fitting or snap-fitting.

The limiting cap 10 of the present embodiment includes the first engagement part 12 made of metal and the fixing part 15 made of resin. Thus, the first engagement part 12 is a member harder than the fixing part 15.

With the structure, the first engagement part 12 of the main body 11 is not easily deformed and is less likely to slip with respect to the second engagement part 52 of the needle valve 50. Therefore, the first splined part 13 is securely engaged with the second splined part 53 of the needle valve 50.

Further, the fixing part 15 of the main body 11 is made of resin which is more flexible than metal. Therefore, the fixing part 15 is easily fixed onto the needle valve fixed part 55 of the needle valve 50. This prevents the needle valve 50 from being rotated about the axis due to displacement, deformation, or slipping of the engagement parts when the needle valve fixed part 55 is fixed onto the fixing part 15. This prevents deviation of a reference value of the fuel-air ratio of the fuel-air mixture. Still further, resin is lighter in weight than metal, to contribute to weight reduction of the limiting cap 10.

The first engagement part 12 is integrally molded with the fixing part 15 of the main body 11 by insert molding in the limiting cap 10 of the present embodiment. The integration of the first engagement part 12 with the fixing part 15 as described above improves production efficiency of the carburetor 1 (fuel adjuster) (the number of assembly steps is reduced).

The embodiment of the present invention has been described above, but the present invention is not limited thereto and can be appropriately modified within the scope of the present invention.

As shown in FIG. 3, the first engagement part 12 and the fixing part 15 of the main body 11 of the limiting cap 10 of the present embodiment are separate members, but the entire main body 11 may be made of resin or metal.

Further, in the present embodiment, the limiting cap 10 is fixed onto the needle valve 50 by press-fitting, but the fixing method is not limited thereto, and various methods may be used, such as adhesion and snap-fitting which those skilled in the art can think of.

As shown in FIG. 1, the present embodiment is directed to the limiting cap 10 which is applied to the carburetor 1

(fuel adjuster) of an internal combustion engine of small outdoor power equipment such as a chain saw or a blower, but a device, to which the limiting cap of the present disclosure is applicable, is not limited thereto.

The limiting cap 10 of the present embodiment is assembled onto the needle valve 50 for adjusting the flow rate of fuel, but may also be assembled onto a needle valve for adjusting a flow rate of air.

REFERENCE NUMERALS

1: carburetor (fuel adjuster), 3: peripheral wall part, 5: adjustment hole, 6: recess, 10: limiting cap, 11: main body, 12: first engagement part, 13: first splined part, 15: fixing part, 16: rising part, 30: guide member, 31: guide hole, 32: guide groove, 50: needle valve, 51: protruding part, 52: second engagement part, 53: second splined part, 55: needle valve fixed part, 56: groove

What is claimed is:

1. A limiting cap assembled onto a needle valve which is screwed into an adjustment hole of a fuel adjuster, comprising:

a main body in a cylindrical shape to be arranged onto a protruding part of the needle valve which protrudes from the adjustment hole, wherein a rising part, which is inserted into a recess formed in the fuel adjuster for restricting rotation of the needle valve, is formed on an outer peripheral surface of the main body, the main body includes an engagement part on a side closer to the adjustment hole and a fixing part on a side away from the adjustment hole with respect to the engagement part, a first splined part formed in an inner peripheral surface of the engagement part is engageable in a circumferential direction of the main body with a second splined part formed in an outer peripheral surface of the needle valve, a needle valve fixed part of the needle valve is press-fitted into the fixing part, at a position away from the adjustment hole with respect to the engagement part, the fixing part is formed to have a smaller inner diameter than the engagement part, and a space, extending from the fixing part to an end surface of the main body away from the adjustment hole, defined in a radial direction between a groove within which a tool is to be inserted and the main body, and including a larger inner radial diameter than any point along an inner surface of the fixing part, the space creating a gap between the needle valve and the limiting cap.

2. The limiting cap as claimed in claim 1, wherein the engagement part and the fixing part are separate members.

3. The limiting cap as claimed in claim 2, wherein the engagement part is a member harder than the fixing part.

4. The limiting cap as claimed in claim 3, wherein the engagement part is made of metal, and the fixing part is made of resin.

5. The limiting cap as claimed in claim 4, wherein the engagement part is integrally molded with the fixing part.

6. The limiting cap as claimed in claim 3, wherein an outer end surface of the main body is fully opened.

7. The limiting cap as claimed in claim 5, wherein an outer end surface of the main body is fully opened.

8. The limiting cap as claimed in claim 3, wherein the fuel adjuster is a carburetor.

9. The limiting cap as claimed in claim 5, wherein the fuel adjuster is a carburetor.

10. The limiting cap as claimed in claim 1, wherein a reference value of a fuel to air ratio associated with the needle valve is substantially unchanged after the assembly of the limiting cap on the needle valve.

11. The limiting cap as claimed in claim 1, wherein the fixing part is configured to permit the needle valve to extend beyond the end surface of the main body away from the adjustment hole when the needle valve fixed part is press-fitted into the fixing part.

* * * * *